US009204219B2

(12) United States Patent
McCarty et al.

(10) Patent No.: US 9,204,219 B2
(45) Date of Patent: Dec. 1, 2015

(54) STEREOPHONIC DEVICE FOR A BED

(71) Applicants: RUOEY LUNG ENTERPRISE CORP., Lu-Kang Town, Changhua County (TW); PPJ. LLC, Natick, MA (US)

(72) Inventors: Philip Woods McCarty, Natick, MA (US); Philip Reid Sherman, Melville, NY (US); Chuan-Hang Shih, Lu-Kang Town (TW)

(73) Assignees: Ruoey Lung Enterprise Corp., Lu-Kang Town, Changhua County (TW); PPJ.LLC, Natick, MA (US)

( * ) Notice: Subject to any disclaimer, the term of this patent is extended or adjusted under 35 U.S.C. 154(b) by 311 days.

(21) Appl. No.: 13/838,741

(22) Filed: Mar. 15, 2013

(65) Prior Publication Data

US 2014/0270283 A1 Sep. 18, 2014

(51) Int. Cl.
*H04R 5/02* (2006.01)
*H04R 1/02* (2006.01)

(52) U.S. Cl.
CPC ..... *H04R 5/023* (2013.01); *H04R 1/028* (2013.01)

(58) Field of Classification Search
None
See application file for complete search history.

(56) References Cited

U.S. PATENT DOCUMENTS

| | | | | | |
|---|---|---|---|---|---|
| 4,023,566 | A * | 5/1977 | Martinmaas | 381/333 |
| 4,124,249 | A * | 11/1978 | Abbeloos | 297/217.4 |
| 4,507,816 | A * | 4/1985 | Smith, Jr. | 381/151 |
| 4,805,731 | A * | 2/1989 | Staley | 181/175 |
| 5,097,821 | A * | 3/1992 | Eakin | 601/47 |
| 7,142,683 | B1 * | 11/2006 | Markow et al. | 381/333 |
| 7,207,413 | B2 * | 4/2007 | Plummer | 181/199 |
| 8,638,959 | B1 * | 1/2014 | Hall | 381/307 |
| 2005/0226449 | A1 * | 10/2005 | Young | 381/333 |
| 2007/0086612 | A1 * | 4/2007 | Nishibori et al. | 381/333 |
| 2011/0095900 | A1 * | 4/2011 | Smith et al. | 340/692 |

* cited by examiner

*Primary Examiner* — Thang Tran
(74) *Attorney, Agent, or Firm* — Muncy, Geissler, Olds & Lowe, P.C.

(57) ABSTRACT

A stereophonic device for a bed disposed adjacent to at least a wave reflecting object is provided. The bed has an upper side and a lower side. The stereophonic device includes a loudspeaker disposed on the lower side of the bed. The loudspeaker is adapted to generate direct sound waves radially propagating therefrom. A part of the direct sound waves propagate through the bed toward the upper side of the bed, and another part of the direct sound waves propagate toward the wave reflecting object, reflected by the wave reflecting object and becoming a reflected sound waves. The reflected sound waves then propagate toward the upper side of the bed and demonstrate stereophonic sound along with the direct sound waves propagating theretoward.

5 Claims, 3 Drawing Sheets

STEREOPHONIC DEVICE FOR A BED

BACKGROUND OF THE INVENTION

1. Field of the Invention

The present invention relates to a sound generating device, and more particularly to a stereophonic device for a bed.

2. Description of the Related Art

To ease away fatigue of the body and soul, some people like to lie on the bed and listen to the music. Therefore, there are some beds provided with loudspeaker(s) which can reproduce the sound of the music.

When it comes to reproduction of stereophonic sound, two or more independent audio channels through a configuration of two or more loudspeakers are normally required. However, such design can lead to more complicate audio signal processing, and more loudspeakers are usually involved.

SUMMARY OF THE INVENTION

Therefore, it is the primary objective of the present invention to provide a simple, inexpensive stereophonic device for a bed.

To achieve this and other objectives of the present invention, a stereophonic device for a bed disposed adjacent to at least a wave reflecting object is provided. The bed has an upper side and a lower side. The stereophonic device includes a loudspeaker disposed on the lower side of the bed. The loudspeaker is adapted to generate direct sound waves radially propagating therefrom. A part of the direct sound waves propagate through the bed toward the upper side of the bed, and another part of the direct sound waves propagate toward the wave reflecting object, reflected by the wave reflecting object and becoming a reflected sound waves. The reflected sound waves then propagate toward the upper side of the bed and demonstrate stereophonic sound along with the direct sound waves propagating theretoward.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
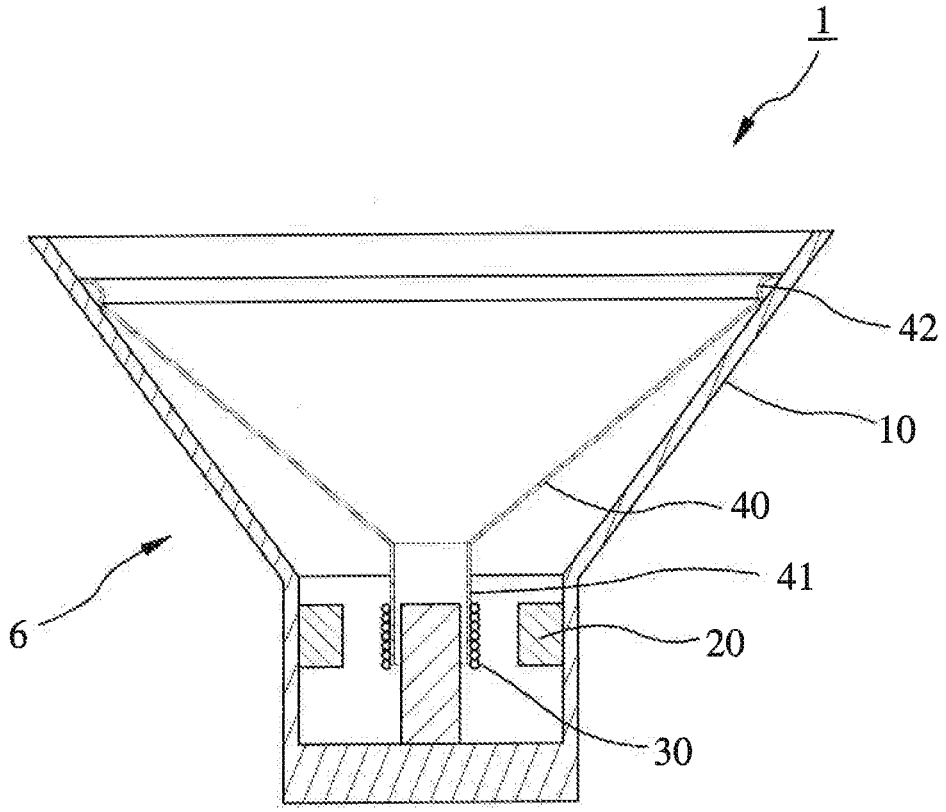
FIG. 1 is a sectional view of a stereophonic device according to a preferred embodiment of the present invention.
Figure 2:
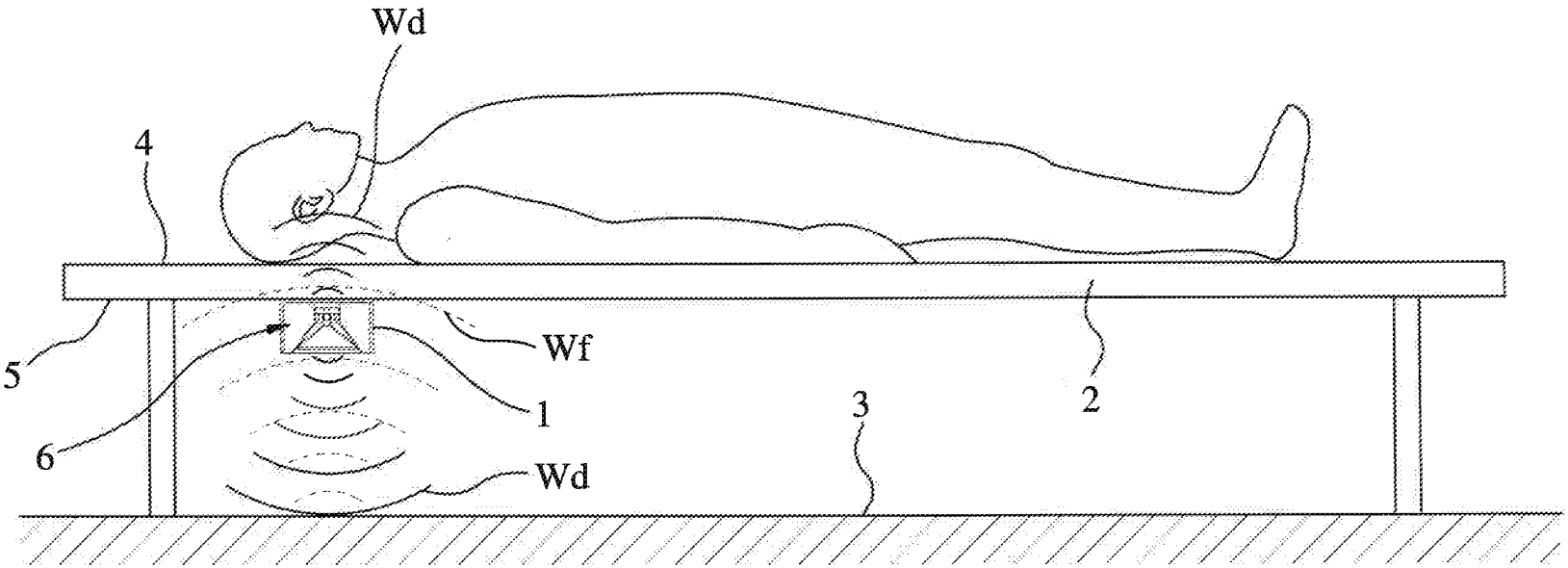
FIG. 2 is a side view of a bed having a stereophonic device according to the preferred embodiment of the present invention, in which direct sound waves are depicted in unbroken lines, and reflected sound waves are depicted in dash-dash-dash lines.

Please refer to FIGS. 1 and 2 for a stereophonic device 1 for a bed 2 disposed adjacent to a wave reflecting object, which in the present embodiment is the floor 3. The bed 2 has an upper side 4 and a lower side 5. The stereophonic device 1 includes a loudspeaker 6 disposed on the lower side 5 of the bed 2. The loudspeaker 6 is adapted to generate direct sound waves $W_d$ radially propagating therefrom. A part of the direct sound waves $W_d$ propagate through the bed 2 toward the upper side 4 of the bed 2, and another part of the direct sound waves $W_d$ propagate toward the wave reflecting object, i.e. the floor 3, reflected by the floor 3 and then becoming reflected sound waves $W_f$. At least a part of the reflected sound waves $W_f$ also propagate toward the upper side 4 of the bed 2 and demonstrate stereophonic sound along with the direct sound waves $W_d$ propagating theretoward because there are time lags between the direct sound waves $W_d$ and the respective reflected sound waves $W_f$ to reach the upper side 4 of the bed 2.

Preferably, the loudspeaker 6 has a cone shell 10 adapted to guide the direction sound waves $W_d$ toward the floor 3, a permanent magnet 20 disposed in the shell 10, a coil electromagnet 30 movably disposed in the shell 10 and a membrane 40 attached to the coil electromagnet 30. In addition, the membrane 40 can be preferably made in cone shape and has a smaller diameter end 41 attached to the coil electromagnet 30 and a bigger diameter end 42. The bigger diameter end 42 is closer to the floor 3 than the smaller diameter end 41 is, and thus the direct sound waves $W_d$ propagating toward the floor 3 can have a higher intensity than the direct sound waves $W_d$ propagating toward the upper side 4 of the bed 2. When the coil electromagnet 30 is powered by an alternating current, the coil electromagnet 30 moves reciprocatingly relative to the permanent magnet 20 along with the membrane 40 so that the membrane 40 can generate the direct sound waves $W_d$.

Figure 3:
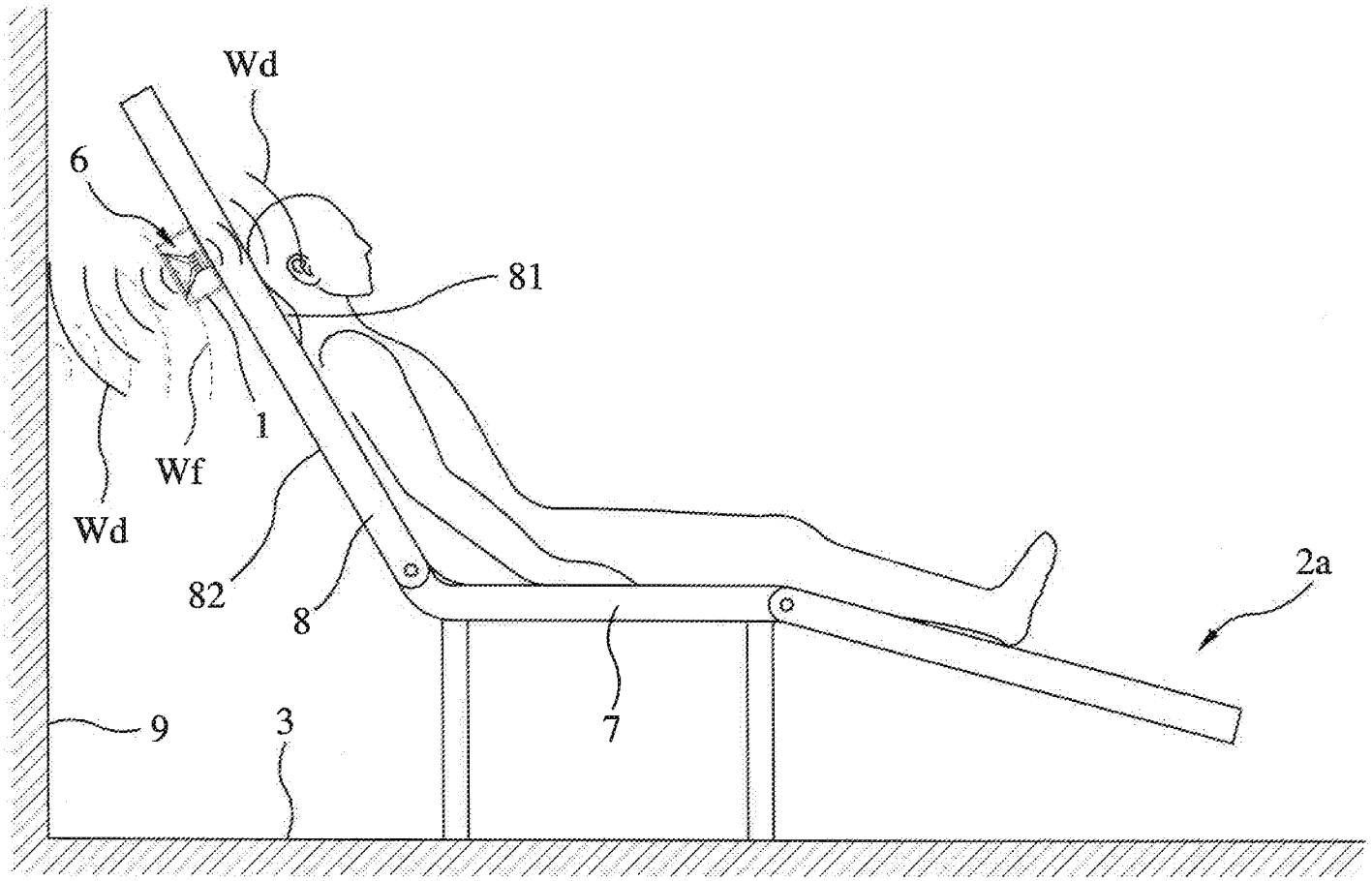
FIG. 3 is a side view of an adjustable bed having a stereophonic device according to the preferred embodiment of the present invention, in which direct sound waves are depicted in unbroken lines, and reflected sound waves are depicted in dash-dash-dash lines.

Please refer to FIG. 3. The bed of the present embodiment is an adjustable bed 2*a* having a stationary first section 7 and a second section 8 pivotable relative to the first section 7. The second section 8 has an upper side 81 and a lower side 82, and the loudspeaker 6 is disposed on the lower side 82 of the second section 8. In addition, there are two wave reflecting objects in the present embodiment, i.e. the floor 3 and the wall 9. Thus when the second section 8 is adjusted upright, a part of the direct sound waves $W_d$ generated by the loudspeaker 6 can propagate toward the wall 9. And yet there are still a small part of the direct sound waves $W_d$ which can propagate toward the floor 3 and be reflected thereby. On the other hand, when the second section 8 is adjusted to align with the first second 7, a part of the direct sound waves $W_d$ can propagate toward the floor 3, and a smaller part of the direct sound waves $W_d$ can propagate toward the wall 9. Either way, the user lying on the bed 2*a* can hear the stereophonic sound demonstrated by the direct sound waves $W_d$ and the reflected sound waves $W_f$. In this manner, the loudspeaker required to demonstrate the stereophonic sound can be reduced compared with the conventional method described hereinabove, and audio signal processing of two or more independent audio channels can also be omitted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bed comprising a stereophonic device, wherein the bed has an upper side and a lower side and is attached to at least a wave reflecting objection, and the stereophonic device comprises a loudspeaker disposed on the lower side of the bed, the loudspeaker generates direct sound waves radially propagating therefrom, a part of the direct sound waves propagating through the bed toward the upper side of the bed, and another part of the direct sound waves propagating toward the wave reflecting object, reflected by the wave reflecting object and becoming reflected sound waves, the reflected sound waves propagating toward the upper side of the bed and demonstrating stereophonic sound along with the direct sound waves propagating theretoward.

2. The bed of claim 1, wherein the bed is an adjustable bed having a stationary first section and a second section pivotable relative to the first section, the second section has an upper side and a lower side, the loudspeaker is disposed on the lower side of the second section.

3. The bed of claim 1, wherein the loudspeaker has a cone shell adapted to guide the direction sound waves toward the wave reflecting object.

4. The bed of claim 3, wherein the loudspeaker has a permanent magnet disposed in the shell, a coil electromagnet movably disposed in the shell and a membrane attached to the coil electromagnet, when the coil electromagnet is powered by an alternating current, the coil electromagnet moves reciprocatingly relative to the permanent magnet along with the membrane so that the membrane generates the direct sound waves.

5. The bed of claim 4, wherein the membrane is in cone shape and has a smaller diameter end attached to the coil electromagnet and a bigger diameter end, the bigger diameter end is closer to the wave reflecting object than the smaller diameter end is.

* * * * *